US005632138A

United States Patent [19]

Liedgens

[11] Patent Number: 5,632,138

[45] Date of Patent: May 27, 1997

[54] STAND FOR RECEIVING SLIVER CANS

[75] Inventor: Hans-Peter Liedgens, Mönchengladbach, Germany

[73] Assignee: W. Schlafhorst AG & Co., Moenchengladbach, Germany

[21] Appl. No.: 517,422

[22] Filed: Aug. 18, 1995

[30] Foreign Application Priority Data

Aug. 18, 1994 [DE] Germany ..... 44 29 254.6

[51] Int. Cl.[6] ..... D01H 9/10; D01H 9/14

[52] U.S. Cl. ..... 57/281; 19/159 A; 57/1 R; 57/90

[58] Field of Search ..... 57/281, 1 R, 268, 57/90, 264; 19/159 A

[56] References Cited

U.S. PATENT DOCUMENTS

| | | | |
|---|---|---|---|
| 2,690,641 | 10/1954 | Keyser | 57/1 R |
| 3,134,144 | 5/1964 | Still | 19/159 A |
| 3,816,991 | 6/1974 | Takeuchi et al. | 57/36 |
| 4,012,893 | 3/1977 | Weber | 19/159 A |
| 4,179,773 | 12/1979 | Savageau | 19/159 A |
| 4,843,810 | 7/1989 | Kabika et al. | 57/268 |
| 5,138,828 | 8/1992 | Stahlecker | 57/90 |
| 5,222,856 | 6/1993 | Yamamoto et al. | 57/281 |
| 5,293,739 | 3/1994 | Brockmanns et al. | 57/263 |
| 5,386,684 | 2/1995 | Simon et al. | 57/268 |
| 5,390,484 | 2/1995 | Shwalm | 19/159 A |
| 5,511,372 | 4/1996 | Liedgens | 19/159 A |

FOREIGN PATENT DOCUMENTS

| | | |
|---|---|---|
| 3621370 | 2/1987 | Germany . |
| 8812622 | 3/1990 | Germany . |
| 4018088 | 1/1991 | Germany . |
| 4231697 | 4/1993 | Germany . |
| 4323726 | 1/1995 | Germany . |

*Primary Examiner*—William Stryjewski
*Attorney, Agent, or Firm*—Herbert L. Lerner; Laurence A. Greenberg

[57] ABSTRACT

A sliver can transport system includes a can vehicle for transporting sliver cans while traveling between a can delivery station, work stations of at least one sliver-processing textile machine having machine parts with fixed locations, a discharge station for empty cans, and path locations within the can transport system. The can vehicle has parking places for the cans, a loading and unloading device for the cans, and a positioning device for positioning the can vehicle relative to the parking places for the cans. At least two spaced-apart can stands each have at least two parking places for sliver cans and the parking places are each combined into self-contained structural units. The structural units have vertically adjustable floor supports for vertically positioning the can stands, and stops for engaging at least one of the fixed locations of the machine parts, a further one of the can stands and the path locations, for horizontal positioning in two degrees of freedom. Position identifiers are each assigned to a respective one of the can stands for detection by the positioning device.

4 Claims, 4 Drawing Sheets

20
S
K
39
34
38
33
40
41
30
A
36
31
37
32
35
190
19

STAND FOR RECEIVING SLIVER CANS

BACKGROUND OF THE INVENTION

Field of the Invention

The invention relates to a sliver can transport system, having a can vehicle for transporting sliver cans and traveling between a can delivery station, work stations of at least one sliver-processing textile machine, and a discharge station for empty cans, a loading and unloading device for sliver cans on the can vehicle, and a positioning device for positioning the can vehicle relative to parking places of the cans.

Many proposals are already known from the prior art to automate the supplying of sliver cans to sliver-processing textile machines, or in other words to automate the transport of sliver cans between a can delivery station, the work stations of the textile machine, and a discharge station for the empty cans. For instance, German Utility Model DE-GM 88 12 622 discloses a device for changing the sliver cans of a spinning machine. The sliver cans are so-called rectangular cans, which are longer than they are wide. They have approximately the same width as a spinning station and thus supply only the spinning station located above them. Therefore, the change of sliver cans can be effected at each spinning station without interrupting the course of work at adjacent spinning stations. In order to allow the sliver cans to be set down in a precise alignment with the spinning stations, the parking places are separated from one another by ribs. In the longitudinal direction, the insertion of the sliver cans is limited by stops. A can transport vehicle that is known from German Published, Non-Prosecuted Application DE 43 23 726 A1, corresponding to U.S. application Ser. No. 08/276,168, filed Jul. 15, 1994, now U.S. Pat. No. 5,511,372, has a changing mechanism adapted to rectangular cans and is capable of performing a positionally accurate can change. The changing mechanism for the sliver cans is suited to picking up empty sliver cans and setting them down on the can transport vehicle and to setting down filled sliver cans, positionally accurately, below the spinning stations.

As the aforementioned references disclose, sliver ends are prepared for automatic insertion into the spinning stations, and are therefore positioned at a defined location on the can so that they can be picked up by the automatic sliver inserters. In order to enable the sliver gripper to engage the sliver end for insertion, the sliver cans must all be aligned in such a way that the sliver ends are in the same three-dimensional position. That can be attained, however, only if the sliver cans are all in the same plane below the spinning stations of the spinning machine. Given the length of a spinning machine, where the region of the spinning stations alone can be over 40 m long, it is not possible to preclude unevenness of the floor. Therefore, stringent demands are made of the parking places for the sliver cans, in view of the required accuracy in the position of the beginning end of the sliver.

However, the demands made in terms of the accuracy of positioning which is achievable for the sliver cans to be set down are made not only of the spinning machine. The same problems as with a spinning machine exist at the can change stations, where the empty sliver cans are set down and filled and where the filled sliver cans are held ready for retrieval by the can transport vehicles.

SUMMARY OF THE INVENTION

It is accordingly an object of the invention to provide a stand for receiving sliver cans, which overcomes the hereinafore-mentioned disadvantages of the heretofore-known devices of this general type and which provides can parking places in such a way that optimal positioning of the sliver cans for automatic manipulation of the cans and sliver is attained.

With the foregoing and other objects in view there is provided, in accordance with the invention, a sliver can transport system, comprising a can vehicle for transporting sliver cans while traveling between a can delivery station, work stations of at least one sliver-processing textile machine having machine parts with fixed locations, a discharge station for empty cans, and path locations within the can transport system; the can vehicle having parking places for the cans, a loading and unloading device for the cans, and a positioning device for positioning the can vehicle relative to the parking places for the cans; at least two spaced-apart can stands each having at least two parking places for sliver cans, the parking places each being combined into self-contained structural units; the structural units having vertically adjustable floor supports for vertically positioning the can stands, and stops for engaging at least one of the fixed locations of the machine parts, a further one of the can stands and the path locations, for horizontal positioning in two degrees of freedom; and position identifiers each being assigned to a respective one of the can stands for detection by the positioning device.

According to the invention, at least two spaced-apart stands for sliver cans are formed, each as self-contained structural units and each having at least two parking places. These can stands include a surface being oriented precisely flatly, such as a sheet-metal panel, which has vertically adjustable floor supports for vertical positioning of the sliver parking places disposed thereon. In order to provide horizontal positioning with two degrees of freedom, stops for fixed locations of machine parts or for a further parking place are provided. In conventional sliver-processing textile machines, such as open-end spinning machines, the sliver cans stand on the floor when the sliver is fed from them into the workstations. As already explained, the unevenness of the floor sometimes makes it impossible for an automatic sliver inserting device, known as a manipulator, to find the position of an end of the sliver protruding from the can. German Utility Model DE-GM 88 12 622 discloses having the sliver cans stand on a parking place between ribs. However, there is no discussion of any possibility of performing a level compensation in the event that the parking places of the sliver cans differ in level from the floor. Conversely, the structural units according to the invention have vertically adjustable floor supports.

As a rule, in textile machines, a plurality of work stations located side by side are combined into so-called sections. It is favorable if the parking places of the sliver cans of one section are combined on a can stand to make one complete structural unit. For example, if a section has 12 work stations, then the can stand also has 12 parking places. The advantage of this kind of structural unit is that each structural unit in one section of the machine can be installed with few manipulations, and the horizontal positioning with two degrees of freedom can be carried out by fixed locations on the machine parts, for example on the section supports, while the vertical alignment, that is the constant spacing at any time from a reference point of the workstation, can be carried out through the use of the vertically adjustable floor supports.

In accordance with another feature of the invention, the can stand that is constructed as a self-contained structural unit of parking places for sliver cans has the same number of parking places as a section of a sliver-processing textile machine.

In accordance with a concomitant feature of the invention, the stand is constructed as a sliver can buffer set up outside a machine.

By lining up the self-contained structural units in rows, with each unit having a section-oriented number of parking places, a so-called pseudo machine can be installed as a can buffer. A can transport vehicle, which transports the sliver cans between a can delivery station and the workstations can, if need be, put the sliver cans in the can buffer. The can stand, that is the self-contained structural units of parking places, can act as a can buffer not only for filled sliver cans but also for empty cans.

The can stands can be used advantageously not only at the workstations of a sliver-processing textile machine but can also be disposed at the can delivery stations and at the discharge stations for empty cans. The can vehicle that transports the sliver cans then finds parking places for sliver cans, at the same level and with the same positioning machines, wherever cans have to be manipulated. It is therefore possible, for instance, for the can transport vehicle, in terms of the number of its can parking places, to match the number of parking places of a self-contained structural unit of parking places. For example, if one section of a sliver-processing textile machine has 12 work places, then the can transport vehicle can, for instance, be disposed in such a way that its transports half of the sliver cans parked on such a section. In addition, it should be possible to provide a can parking place that upon a change of sliver cans at the work place of a textile machine makes it possible first to pick up an empty can before a full can is able to be set down on the thus-cleared parking place. Thus, in one trip, a can transport vehicle with seven parking places, for instance, would be capable of transporting six cans, or in other words half the number of one section of a sliver-processing textile machine.

Other features which are considered as characteristic for the invention are set forth in the appended claims.

Although the invention is illustrated and described herein as embodied in a stand for receiving sliver cans, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
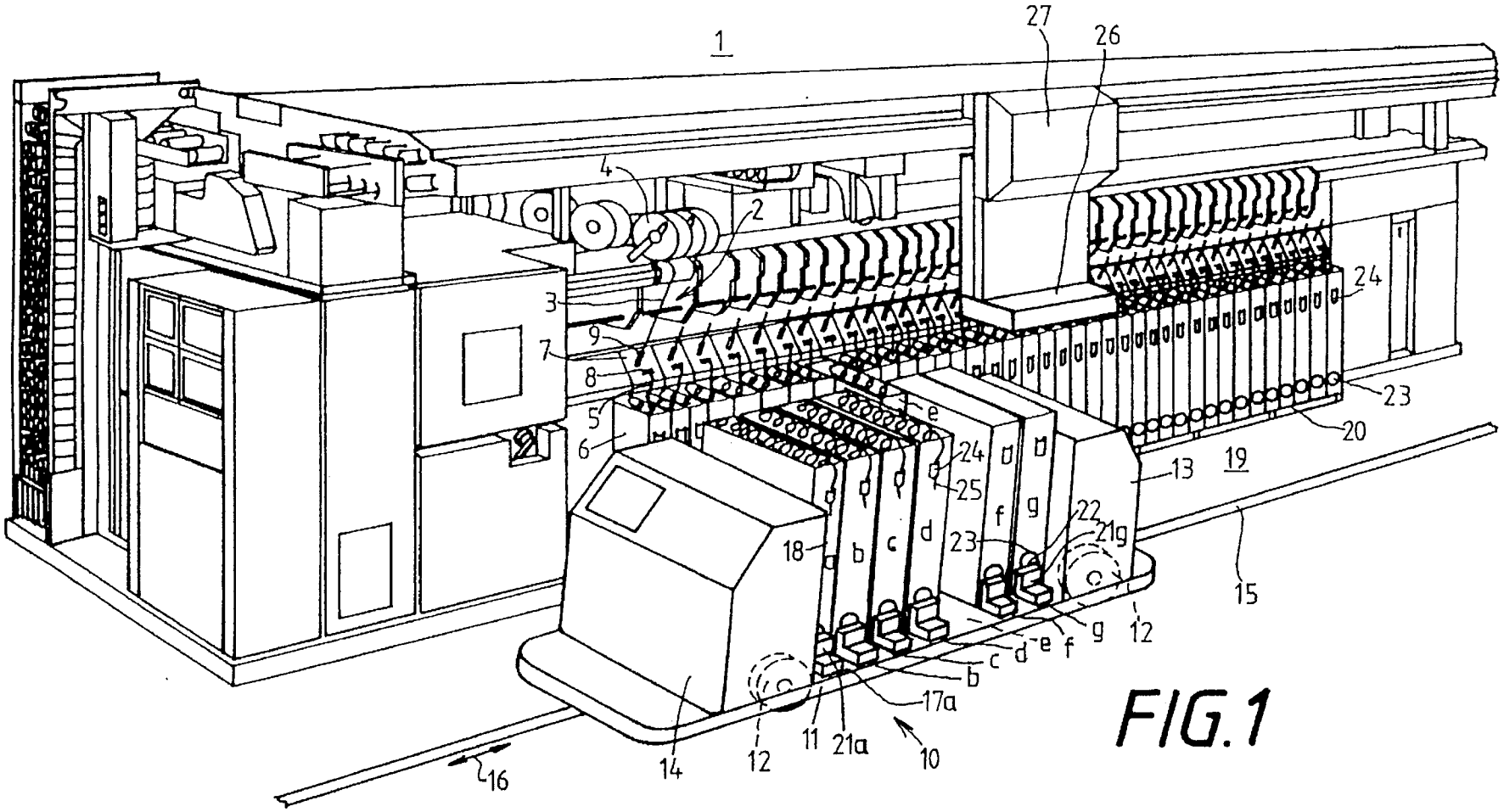
FIG. 1. is a fragmentary, diagrammatic, perspective view of an open-end spinning machine with a transport vehicle located in front of it, upon a change of a sliver can at a spinning station.

Referring now to the figures of the drawing in detail and first, particularly, to FIG. 1 thereof, it is seen that reference numeral 1 diagrammatically illustrates an open-end spinning machine, as an example of a sliver-processing textile machine. The machine includes a number of spinning stations 2, located side by side. In each of these spinning stations, yarn 3 is spun and wound up onto cross-wound bobbins or cheeses 4. The yarn is spun in a known manner from sliver 5 and is drawn by a so-called condenser 8 from sliver cans 6 into a so-called spinning box 7, where the yarn formation takes place. The finished yarn 3 leaves the spinning box 7 through a draw-off tubule 9.

One can 6 is assigned to each spinning station 2. The cans stand side by side below the spinning stations. The cans have an elongated rectangular shape, so that the cans can easily be disposed beneath the spinning stations. Each can is approximately as wide as one spinning station. The yarn formation and the function of an open-end spinning machine will not be explained further herein, because they are not the subject of the invention and are already known from the prior art.

A can transport vehicle 10 is positioned in front of the spinning machine 1. In FIG. 1, the can transport vehicle 10 is just exchanging an empty sliver can for a filled one at a spinning station. The transport vehicle 10 includes a chassis 11 with steerable and driven wheels 12. The transport vehicle has a rectangular outline and on one short side on its vehicle frame it carries a drive device 13, with a non-illustrated motor that in this case drives the wheels 12, and a control device 14 that processes control commands and controls can changes.

In the present exemplary embodiment, the can transport vehicle 10 is guided along the spinning machine 1 through the use of an induction loop 15 and from there it is guided to an empty, non-illustrated can discharge station, to a can delivery station for filled sliver cans, optionally to further non-illustrated spinning machines and to a so-called can buffer, which can temporarily store filled sliver cans, for instance. Temporary storage of empty cans can also be provided for in a can buffer.

The motion along the induction loop 15 can be in both directions of travel, as is symbolically represented by a double arrow 16. The transmission of control commands can also be carried out through radio signals. The positioning in front of the various work stations can be carried out, for instance, through the use of devices that are known from German Utility Model DE-GM 88 12 622.

In the present exemplary embodiment, the can transport vehicle 10 has seven parking places 17*a*–17*g* for rectangular cans. In terms of the travel direction 16 of the can transport vehicle 10, rectangular cans 18*a*–18*g* stand broad side to broad side one after the other. The sliver can 18*e* is just being thrust below a spinning station in FIG. 1. The cans 18*f* and 18*g* on the parking places 17*f* and 17*g* are empty cans, which have already been replaced by full cans at spinning stations.

The cans 6 at the textile machine 1 are raised somewhat above a normal floor 19 on the can stands according to the invention, which form a self-contained structural unit 20 of can parking places. The can stand according to the invention makes it easier for the can transport vehicle 10 to change the sliver cans, since all of the cans are located at the same level.

One can changer 21*a*–21*g* is provided for each of the parking places 17*a*–17*g* on the can transport vehicle 10. The can changer may be constructed in accordance with FIGS.

2–4 of German Published, Non-Prosecuted Application DE 43 23 726 A1, corresponding to U.S. application Ser. No. 08/276,168, filed Jul. 15, 1994, now U.S. Pat. No. 5,511,372. By way of example, the cans can be manipulated through the use of an actuatable magnet 22, which enters into operative connection with a magnetizable metal plate 23 mounted on end surfaces of the cans. However, a can manipulator of the kind shown and described in FIGS. 6–8 of German Published, Non-Prosecuted Application DE 43 23 726 A1, corresponding to U.S. application Ser. No. 08/276,168, filed Jul. 15, 1994, now U.S. Pat. No. 5,511,372 is also conceivable. Since the embodiment of the can manipulator is not the subject of the invention, other can manipulators which are capable of thrusting the cans beneath the working stations can also be used.

The sliver cans have clamps 24 on their end surfaces, which are oriented toward the associated workstation. In the case of the cans 18*a*–18*d*, a beginning end 25 of the sliver is firmly fixed in the sliver clamp 24 at a defined length. As a result, it is possible by using a manipulator to introduce the beginning 25 of the sliver into the spinning station. This can be carried out, for instance, by using a yarn inserter 26, which is disposed on a servicing device 27 that patrols along the work stations of the spinning machine and carries out a piecing operation, for instance after a yarn break or after a change of sliver cans. In order to enable the carrying out of a piecing operation if a sliver can has been changed, the sliver must first be placed from the new can into the spinning station. This is performed fully automatically, through the use of a manipulator which is known, for instance, from German Published, Non-Prosecuted Application DE 42 04 044 A1, corresponding to U.S. Pat. No. 5,293,739. In order to assure that such a device for automatically delivering the sliver will always find the sliver at the same location, the sliver clamps must all be aligned in the same three-dimensional position. Such an alignment is advantageously possible with the parking places that are combined according to the invention into a structural unit, since they are vertically adjustable and thus can be aligned with respect to the sliver manipulator.

Figure 2:
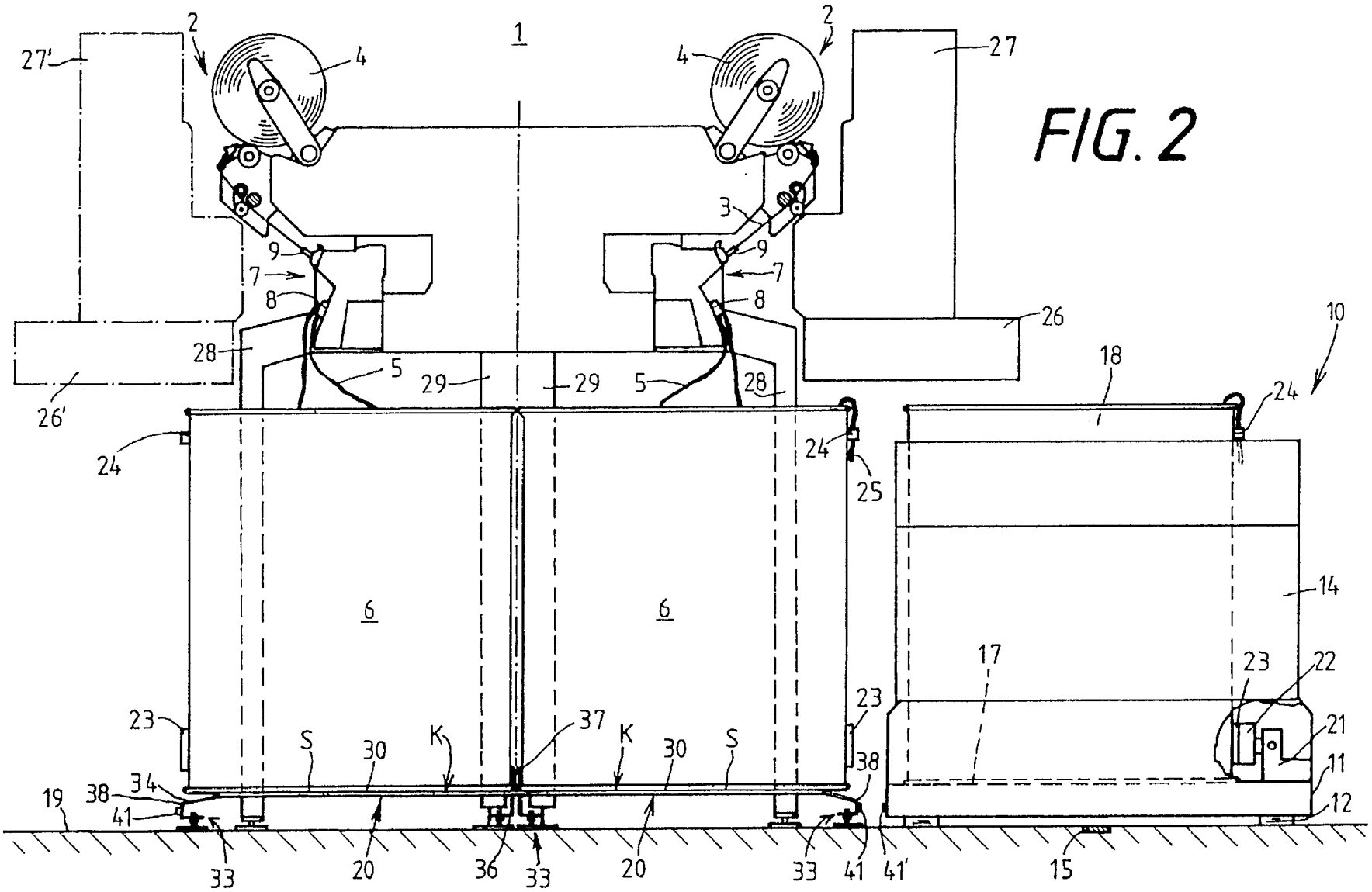
FIG. 2 is a side-elevational view of a section through the open-end spinning machine at a spinning station, with a transport vehicle for sliver cans that is positioned in front of the spinning stations.

FIG. 2 shows a side view of a section through the open-end spinning machine. The section is taken at a boundary between two spinning stations which are located next to one another. The spinning machine is a double-sided spinning machine, so that pairs of work stations abut one another at their backs. The parking places for the cans are disposed in such a way that the cans each abut at their backs when they are disposed below the spinning stations. A servicing device 27' and a sliver inserter 26' connected to it are shown in phantom by dot-dashed lines indicating their outlines. By way of example, these devices can additionally be provided in such a way that the spinning stations can be serviced simultaneously on both sides.

A can stand K with parking places S can be seen in cross section below the sliver cans 6. The various structural units 20 of the various sections abut one another with their backs below the spinning stations and are screwed together there. They are fitted between fixed locations of machine parts, namely supports 28 and 29 of the respective sections.

Figures 3A, 3B, 3C:
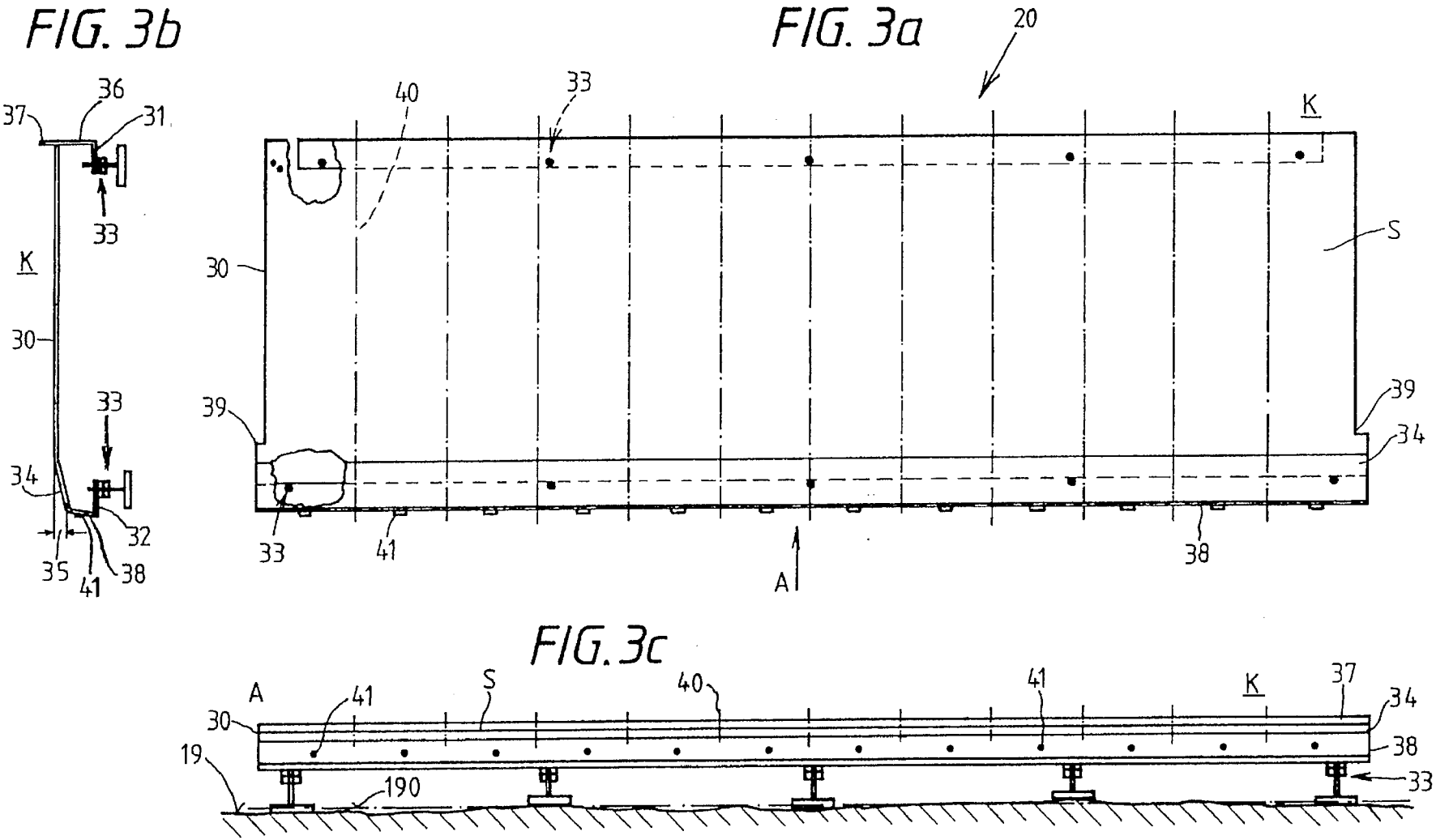
FIG. 3*a* is a partly broken-away plan view of silver can parking places, forming a self-contained structural unit.
FIG. 3*b* is a cross-sectional view through the structural unit.
FIG. 3*c* is a front-elevational view of the structural unit.

FIG. 3*a* shows a plan view on a can stand K, which forms a self-contained structural unit 20 of parking places S. The structural unit includes a sheet-metal panel 30, which is bent in a U on each of its long sides. Short legs 31 and 32 of the U profile are oriented toward the floor 19, as is shown in FIG. 2. Vertically adjustable floor supports 33 are disposed at regular, fixed intervals in the short legs 31 and 32 of the various U profiles, to enable vertically aligning the sheet-metal panels 30. With the aid of the vertically adjustable floor support 33, it is possible to compensate for unevenness of the floor 19, as can be seen from FIG. 3*c*. While in FIG. 3*c* a dot-dash line 190 indicates an ideal profile for the floor, the solid line 19 indicates the actual profile of the floor. As can be seen from FIG. 3*c*, it is possible with the vertically adjustable floor supports 33 to align the structural unit 20 parallel to the ideal profile 190 of the floor.

The side of the structural unit facing toward the can transport vehicle 10 has an incline 34. The incline facilitates the transfer of cans from the can transport vehicle to the parking places as well as the takeover of cans onto the can transport vehicle. Through the use of the incline 34, any unevenness in the floor, of the kind which is visible in FIG. 3*c* and having an effect on the position of the can transport vehicle, is attenuated. If the can transport vehicle is standing in such a way that its parking places 17*a*–17*g* are located at a lower level than the surfaces of the can parking places, then the cans to be transferred can be raised to the parking places S through the incline 34. The parking places S of the structural unit 20 cannot be any higher than the parking places 17*a*–17*g* of the can transport vehicle 10 than the distance made possible by the compensation of the level difference performed by the incline 34 dictated by a height difference 35.

The cross section through the structural unit 20 of parking places S shows that there is a stop 37 on a rear bottom leg 36 of the U-shaped profile, so that when the cans are slipped on they cannot be pushed beyond the rear edge. As is seen from FIG. 2, the structural units 20 associated with the various sections are screwed together by their backs 36, below the abutting spinning stations 2.

In the plan view of the structural unit 20 in FIG. 3*a*, dot-dashed lines demarcate the parking places S of the cans. Points are also shown where the vertically adjustable bottom supports 33 can be screwed in. Recesses 39 are provided on right-hand and left-hand short sides of the structural group 20, so that the structural group can be inserted between the supports 28 and 29 of the respective sections on the machines. If the structural units are each to be set up by themselves as can buffers outside a machine, then at those locations the screw fastenings can be made to intervening supports, so that the cans, particularly those set up in the peripheral regions, will not fall out at the side.

In the present exemplary embodiment, the surface of the sheet-metal panel 30 encompassing the parking places S of the can stand K of the structural unit 20 is flat. It is also possible, however, as in German Utility Model DE-GM 88 12 622, to provide ribs that serve to guide the cans. Such ribs can be advantageous, and can be mounted in accordance with the dot-dash lines on the surface of the sheet-metal panel 30, whenever the cans are narrower than the parking places. If each of the cans are just as wide as the parking places, then the possibility exists of self-alignment of the cans in accordance with the boundary of the parking places that are provided. The lateral guides of the cans can also be disposed adjustably or can be constructed as beads impressed into the sheet-metal panel 30. However, if the sheet-metal panel were profiled to provide lateral guidance to the cans, then the fixation to a certain can width would be effected in this way.

There are various possible ways of assigning the cans to the various parking places S on the various structural units 20 of a textile machine or on the can stands K of a can buffer. For instance, a marking or a sensor 41 can be provided on an end surface 38 of the structural unit at each parking place S, as can be seen from the front view of the structural unit 20 in FIG. 3*c*. By way of example, this marking can be an addressable memory chip, in which the data of the can deposited on this parking place can be written by the can transport vehicle. It is also possible, however, to provide a device for bidirectional communication at each can parking place, so that the can transport vehicle setting down or picking up a can is able to communicate at the particular parking place with a transceiver that is installed there, which receives all of the information pertaining to the can and upon a search for a certain can outputs this information again to the can transport vehicle that is looking for it. An information carrier can also be provided on the can itself. The coding of the can is able to take various forms. The can transport vehicle in this case comes into operative connection with each of the cans in order to identify them. Then no markings or sensors are necessary at the parking place of the particular can.

If devices at the parking places have the capability of information storage, then these information memories can be connected with a non-illustrated central memory and control unit, which as a result is capable at any time of providing information on the way in which the memory places are occupied. Every occupation, each removal of a can and each can change can be carried out by the can transport vehicle through the use of a bidirectional data exchange with a read/write device at a can parking place. The structural groups provided as can buffers will be equipped in the same way in such a case as a machine and will thus be detected by the can transport vehicle as a pseudo machine.

The can transport vehicle will recognize whether a pseudo machine, or in other words a can stand K acting as a can buffer, is present, or an actual textile machine 1, from the fact that the can stands K are each assigned a position identification PE that can be detected by a positioning device PM. A sliver can transport system according to the invention will be described below in conjunction with FIG. 4.

Figure 4:
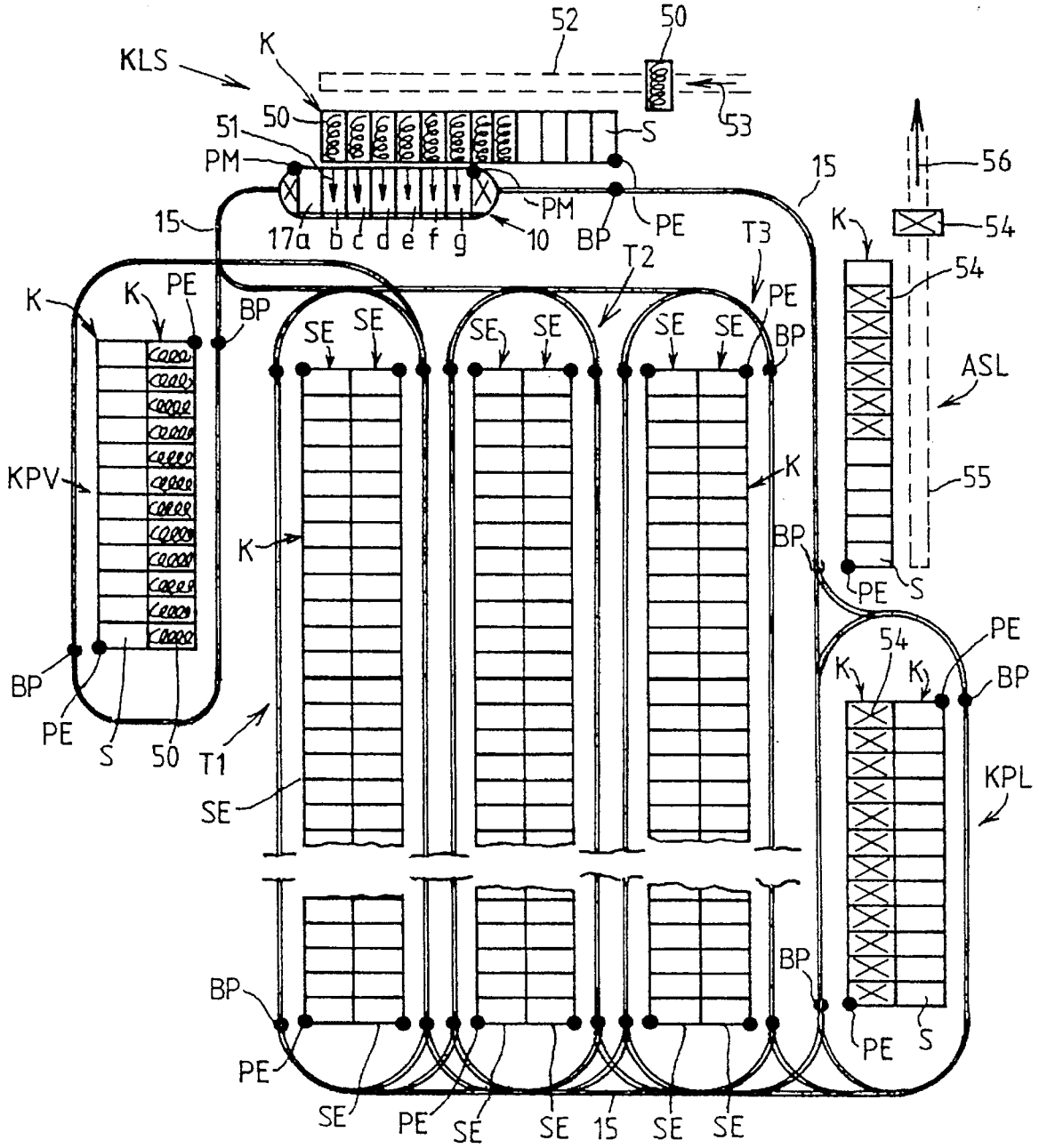
FIG. 4 is a partly broken-away plan view of a sliver transport system according to the invention.

In FIG. 4, the can transport vehicle 10 is located at a can delivery station KLS in order to fill its empty parking places with filled sliver cans 50. While the parking place 17*a* remains free to receive an empty can the first time that a can change takes place, the parking places 17*b*–17*g* are loaded with the filled cans 50, as is indicated by arrows 51. The filled sliver cans 50 are brought on a transport device 52 from a non-illustrated path where the cans are filled, as is indicated by an arrow 53. They are set down onto the can stand K at the can delivery station KLS by the transport device 52. This can stand K includes 12 parking places S for sliver cans. The number of parking places S on a can stand K corresponds to the number of parking places in a section SE of one of three sliver-processing textile machines T1–T3 shown in FIG. 4. Each of the textile machines T1–T3 includes at least two sections SE of workstations, and each section includes the same number of workstations. Each section SE is assigned one can stand K, having parking places S which are each assigned to the work stations located above them.

The can transport vehicle 10 is carried from the can delivery station KLS to the various textile machines T1–T3 through the use of the induction loop 15.

Aside from the textile machines T1–T3, even more parking places for cans are provided. For instance, a can buffer KPV for full cans is provided next to the textile machines and is reachable directly from the can delivery station KLS. A can buffer KPL for empty cans is located before a discharge station ASL for empty cans. Both the full-can buffer KPV and the empty-can buffer KPL include two can stands K in the present exemplary embodiment, which are screwed to one another at their backs. Each can stand offers the same number of parking places S as a section SE has in each of the textile machines T1–T3. A first can stand K of the can buffer KPV for full cans is already occupied with sliver-filled cans 50, while a second can stand K still has parking places S that are entirely empty.

The empty-can buffer KPL in the present example likewise includes two can stands K, which are again screwed together at the back and are enclosed by the closed loop 15 for the travel path of the can transporter 10. Once again, the can stands K each have as many parking places as one of the sections SE of one of the textile machines T1–T3. One can stand K is already entirely filled with empty cans 54. The parking places S of the other can stand K are not yet occupied.

The full-can buffer KPV offers the opportunity, for example in the case of overproduction or at batch changing times and upon cancellation of orders, to temporarily store the full cans 50 that are output by the can delivery station KLS for a certain period of time. The empty-can buffer KPL, in the event of disruptions along the path or for other reasons, can store unneeded empty cans 54 temporarily for a certain period.

Before the can vehicle 10 is loaded with filled sliver cans, it discharges its empty cans 54 at the discharge station ASL for empty cans. The discharge station for empty cans in this case again includes a can stand K with a number of parking places S for empty cans 54 that matches the number of parking places at one section SE of one of the textile machines T1–T3. The empty cans are transported on a transport device 55 to the filling station along the non-illustrated path, as is indicated by an arrow 56.

In order to ensure that the can transport vehicle, over its path that is specified by the induction loop 15 in the illustrated exemplary embodiment, will detect whether it has arrived, for instance, at a pseudomachine, that is a can buffer KPV for full cans or a can buffer KPL for empty cans, or has reached one of the textile machines T1–T3 or the can delivery station KLS for full cans or the discharge station ASL for empty cans, the can stands K each have the position identifier PE that is detectable by the positioning device PM of the can vehicle 10. These position identifiers PE are suitably disposed at the beginning of a can stand K, in terms of the direction of arrival of the can transport vehicle 10. Thus the can transport vehicle 10 can position itself at each can stand K for an intended can change. A further locational determination is possible through the use of path locations BP which, for instance, are disposed in the induction loops 15, and relative to which the can stands K can be aligned.

I claim:

1. A sliver can transport system, comprising:

a can vehicle for transporting sliver cans while traveling between a can delivery station, work stations of at least one silver-processing textile machine having machine parts, a discharge station for empty cans, and path locations within the can transport system, wherein each of the can delivery station, the work stations, and the discharge station has respective parking places for the cans;

said can vehicle having parking places for the cans, a loading and unloading device for the cans, and a positioning device for positioning said can vehicle relative to the work stations of the textile machine, such that parking places on the can vehicle are associated with respective parking places at the work stations, at the can delivery station, and at the discharge station, respectively;

at least two spaced-apart can stands each having at least two parking places for sliver cans; said can stands having vertically adjustable floor supports for vertically positioning said can stands, and said can stands being formed with stops being positionable relative to fixed locations defined on at least one of said machine parts, a respectively other of said can stands and said path locations, for horizontal positioning in two degrees of freedom; and position identifiers each being assigned to a respective one of said can stands for detection by said positioning device.

2. The sliver can transport system according to claim 1, wherein each of said structural units has the same number of parking places as the number of said work stations of one section of said at least one sliver-processing textile machine.

3. The sliver can transport system according to claim 1, wherein at least one of said can stands is disposed as a can buffer outside said at least one sliver-processing textile machine.

4. A sliver can transport system, comprising:

a can vehicle for transporting sliver cans while traveling between a can delivery station, work stations of at least one silver-processing textile machine with machine parts, a discharge station for empty cans, and path locations within the can transport system;

said can vehicle having parking places for the cans, a loading and unloading device for the cans, and a positioning device for positioning said can vehicle relative to the work stations of the textile machine;

at least two spaced-apart can stands each having at least two parking places for sliver cans;

said can stands having vertically adjustable floor supports for vertically positioning said can stands, and said can stands being formed with stops for horizontal positioning in two degrees of freedom, said stops being positionable relative to fixed locations defined on at least one of said machine parts, a respectively other of said can stands, and said path locations; and position identifiers each being assigned to a respective one of said can stands for detection by said positioning device.

* * * * *